US010882541B2

(12) United States Patent
Kremmel et al.

(10) Patent No.: US 10,882,541 B2
(45) Date of Patent: Jan. 5, 2021

(54) HEIGHT CONTROL MECHANISM

(71) Applicant: LIEBHERR-TRANSPORTATION SYSTEMS GMBH & CO. KG, Korneuburg (AT)

(72) Inventors: Daniel Kremmel, Zwischenwasser (AT); Christian Deutsch, Vienna (AT)

(73) Assignee: LIEBHERR-TRANSPORTATION SYSTEMS GMBH & CO. KG, Korneuburg (AT)

( * ) Notice: Subject to any disclaimer, the term of this patent is extended or adjusted under 35 U.S.C. 154(b) by 193 days.

(21) Appl. No.: 15/770,115

(22) PCT Filed: Oct. 20, 2016

(86) PCT No.: PCT/EP2016/001739
§ 371 (c)(1),
(2) Date: Apr. 20, 2018

(87) PCT Pub. No.: WO2017/067662
PCT Pub. Date: Apr. 27, 2017

(65) Prior Publication Data

US 2018/0312175 A1 Nov. 1, 2018

(30) Foreign Application Priority Data

Oct. 21, 2015 (DE) ..... 10 2015 013 605

(51) Int. Cl.
*B61F 5/22* (2006.01)
*B61F 5/06* (2006.01)

(52) U.S. Cl.
CPC . *B61F 5/22* (2013.01); *B61F 5/06* (2013.01)

(58) Field of Classification Search
CPC ..... B61F 5/00; B61F 5/02; B61F 5/04; B61F 5/06; B61F 5/10; B61F 5/12; B61F 5/14
See application file for complete search history.

(56) References Cited

U.S. PATENT DOCUMENTS 5,588,368 A 12/1996 Richter et al.
6,637,348 B1 * 10/2003 Teichmann ..... B60G 17/0272 105/199.1
7,520,494 B2 4/2009 Gaile
7,874,254 B2 1/2011 Lehmair et al.
(Continued)

FOREIGN PATENT DOCUMENTS

DE 19651138 A1 6/1997
DE 20105329 U1 6/2001
(Continued)

OTHER PUBLICATIONS

ISA European Patent Office, International Search Report Issued in Application No. PCT/EP2016/001739, dated Jan. 23, 2017, WIPO, 6 pages.

*Primary Examiner* — Robert J McCarry, Jr.
(74) *Attorney, Agent, or Firm* — McCoy Russell LLP

(57) ABSTRACT

The invention relates to a height control mechanism for a rail vehicle comprising suspension units that are arranged between the body and the bogie of the rail vehicle and that each comprise a spring, a pneumatic or a hydraulic reciprocating piston element. In accordance with the invention, the reciprocating piston element is retracted so much in train operation that it does not bridge the spacing between the body and the bogie.

14 Claims, 6 Drawing Sheets

(56) References Cited

U.S. PATENT DOCUMENTS

| | | | |
|---|---|---|---|
| 8,899,159 | B2 | 12/2014 | Zanutti et al. |
| 2002/0060384 | A1 | 5/2002 | Kazmeier et al. |

FOREIGN PATENT DOCUMENTS

| | | | |
|---|---|---|---|
| DE | 10056929 | A1 | 5/2002 |
| DE | 10315000 | A1 | 11/2003 |
| DE | 10238059 | A1 | 3/2004 |
| DE | 10360516 | A1 | 7/2005 |
| DE | 10360518 | A1 | 7/2005 |
| DE | 102005018945 | A1 | 10/2006 |
| DE | 202005009909 | U1 | 10/2006 |
| DE | 202009015029 | U1 | 6/2010 |
| WO | 2012115927 | A1 | 8/2012 |

* cited by examiner

HEIGHT CONTROL MECHANISM

CROSS-REFERENCE TO RELATED APPLICATIONS

The present application is a U.S. National Phase of International Patent Application Serial No. PCT/EP2016/001739, entitled "HEIGHT CONTROL MECHANISM," filed on Oct. 20, 2016. International Patent Application Serial No. PCT/EP2016/001739 claims priority to German Patent Application No. 10 2015 013 605.4, filed on Oct. 21, 2015. The entire contents of each of the above-mentioned applications are hereby incorporated by reference in their entirety for all purposes.

TECHNICAL FIELD

The invention relates to a height control mechanism for a rail vehicle that has suspension units that are arranged between the body and the bogie of the rail vehicle.

BACKGROUND AND SUMMARY

Rail vehicles typically have a primary suspension and a secondary suspension. The primary suspension acts between the wheel axles of the rail vehicle and the bogie and primarily serves the absorption of hard impacts to which the rail vehicle is exposed during travel due to uneven rail guidance and the like. The secondary suspension is arranged between the body and a track-bound bogie of the rail vehicle. This secondary suspension is in particular used for an additional vibration isolation of the body in order in particular to enable a comfortable trip in passenger transportation.

It is known in the simplest case to use conventional steel springs or elastomer springs for the secondary suspension in addition to an air suspension or a hydropneumatic suspension. As a rule, the body is cushioned with respect to the bogie via two or more such passive spring elements with respect to the bogie, with the bogie as a rule supporting a pair of wheel axles that establish the contact to the rail.

However, the problem occurs with a secondary suspension that the body height can also change depending on the load. The body height is the height level of the body relative to the bogie or to the upper rail edge.

To enable a height control of the body height simultaneously with the desired suspension, pneumatic or hydropneumatic suspension units were used for the secondary suspension instead of the conventional steel suspension. Solutions for a height control mechanism for setting the height level of the body are known, for example, in the form of a pneumatic secondary suspension that are, for example, additionally pressurized in railway stations to adapt the height level to the platform height and are thereby raised. Similar solutions are also known in the form of hydropneumatic springs such as are described in DE 100 56 929 A1 or DE 102 38 059 A1.

In vehicles having secondary springs composed of steel or elastomer springs, the spring travel on the deflection of these springs has to take place via a parallel or serial elevation of the vehicle such as described in WO 202/115927 A1 or DE 202 00 500 9909 U1.

A different kind of height control is known as a so-called "pull-down" principle from DE 102 005018945 A1 or DE 103 605 18 A1. The total vehicle is here lowered to the height of the platform edge with respect to the unloaded state.

It is a disadvantage of the previous solution overall that the total car weight with the corresponding load due to passengers or the like always has to be raised. The load due to the passengers or the like here only represents a small portion of the total load. All the lateral forces furthermore have to be transmitted via the hydraulic cylinder or pneumatic cylinder. With the so-called "pull-down" solutions, there is furthermore the disadvantage that the secondary spring is compressed to a maximum at each station and thereby undergoes an increased load. A high power requirement also results here with an empty or almost empty rail vehicle.

The demand is made on modern rail vehicles that the platform edge height should be observed as exactly as possible on the stopping of the rail vehicle. The access height at the height of the platform edge should be observed independently of the load state.

It is now the object of the invention to provide a height control mechanism that enables such a height setting of the rail vehicle independently of the load state, with there being an energy requirement that is as small as possible.

A height control mechanism of the category is further developed in accordance with the characterizing features of claim 1 to achieve this object.

A height control mechanism for a rail vehicle is provided here that comprises suspension units that are arranged between the body and the bogie of the rail vehicle and each comprise at least one spring and one pneumatic or hydraulic reciprocating piston element. In accordance with the invention, the reciprocating piston element is retracted so much in train operation that it does not bridge the spacing between the body and the bogie. A complete decoupling of the reciprocating piston element in train operation thus results from the bogie to the body.

As a result, only the spring acts between the body and the bogie during the trip. The pneumatic and hydraulic reciprocating piston element now only serves in accordance with the present solution to assist the spring, i.e. the secondary spring, when the body has to be raised to a greater height, for example to the platform height. If, for example, the rail vehicle is loaded by persons and baggage and if the height of the rail vehicle drops with respect to the reference height, the body is raised by the pneumatic or hydraulic reciprocating piston element to the original vehicle height of the empty rail vehicle or to slightly above it.

Substantially less energy is thus used due to the solution in accordance with the invention since the required height control energy is reduced to the actual proportional load. In the aforesaid prior art, either the total body also had to be raised or work had to take place against the secondary spring in the so-called "pull-down" principle.

A further advantage of the height control mechanism in accordance with the invention comprises the transverse force transmission being minimized by the reciprocating piston element serving as a leveling element between the body and the bogie. The reciprocating piston element itself can thereby be very compact in design.

The reciprocating piston element bridges the secondary springs on the height adaptation to the platform edge. A desired stiff behavior on the boarding or alighting of the passengers or on loading and unloading hereby results in an advantageous manner. The unwanted rocking of the rail vehicle that occurs on the passenger exchange at the station with conventional systems can be reliably prevented or at least reduced by a large amount through the solution in accordance with the invention.

Finally, the failure of the height control mechanism in accordance with the invention does not result in a failure of the suspension units. An adaptation to the height of the platform edge is admittedly no longer possible. However, this has no relevance to safety for the total system of the suspension units. Even the comfort of the suspension of the rail vehicle is not impaired.

Advantageous embodiments of the height control mechanism in accordance with the invention result from the dependent claims following on from the main claim.

For example, the reciprocating piston element of the suspension unit can here be surrounded by the spring, for example. It is particularly advantageous here that the reciprocating piston element can be very compact in design. The integration within the spring is hereby simplified from a construction aspect.

In accordance with an alternative embodiment, the reciprocating piston element of the suspension unit can, however, also be arranged outside the spring and in parallel therewith.

The spring can advantageously be designed as a steel spring, an air bellows, an elastomer element and/or as a hydropneumatic spring.

The working medium to act on the reciprocating piston element can be supplied at the side of the body or also at the side of the bogie. The supply at the side of the body is, however, of particular advantage since a smaller vibration level is present here so that the feed lines of the working medium are exposed to smaller vibrations.

Liquids such as hydraulic oil or emulsions or also gases such as compressed air can be used as the working medium for the reciprocating piston element.

Elastomers are particularly preferably arranged as an emergency damping element between the bogie and the reciprocating piston element. This makes it possible, for example on the breakage of a spring element and on overload, that the total force that would have to be led off via the cylinder housing of the reciprocating piston element is absorbed by the elastomer so that an emergency damping takes place here.

In accordance with a further advantageous embodiment of the invention, a distance measurement system can cooperate directly or indirectly with the reciprocating piston element.

BRIEF DESCRIPTION OF THE FIGURES

Further features, details and advantages of the invention result from the embodiments shown with reference to the Figure. There are shown.

DETAILED DESCRIPTION

Figure 1:
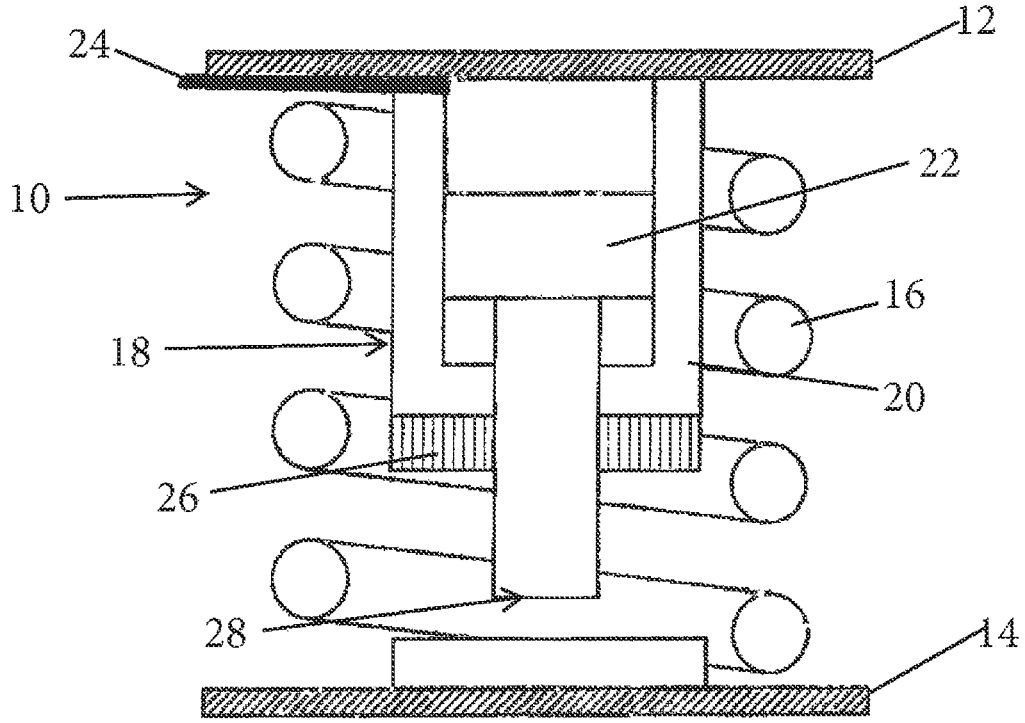
FIG. 1: the sectional representation of a spring unit of a height control mechanism in accordance with the invention for a rail vehicle in accordance with a first embodiment of the invention in regular train operation.

FIG. 1 shows a sectional representation of a suspension unit 10 that is arranged between a body 12 of a rail vehicle no longer shown here and a bogie 14 that is here likewise only shown schematically.

The suspension unit comprises a spring 16 and a reciprocating piston element 18. The reciprocating piston element 18 in turn comprises a cylinder 20 and a piston 22 displaceably supported therein. The piston 22 of the reciprocating piston element 18 is acted on by a working medium that is conveyed into the cylinder 20 via a pressure line 24 at the one side of the piston 22.

Hydraulic working media such as hydraulic oil or emulsions or pneumatic working media such as compressed air are used as the working medium in the reciprocating piston element as part of the present invention. Any other conventional working medium can likewise be used to travel the reciprocating piston element.

The pressure line 24 is arranged at the side of the bogie in the embodiment shown in FIG. 1. An elastomer layer 26 is applied to the lower side of the cylinder 20 and can, as will be described below, act as a damping element.

The height control mechanism in accordance with the invention having the suspension unit 10 is shown in regular train operation in FIG. 1. The reciprocating piston element 18 is retracted so much here that it does not bridge the spacing between the body 12 and the bogie 14. This is clear here in that the lower side 28 of the piston 22 is not supported at the bogie 14. The height level of the rail vehicle is therefore only determined by the height of the spring 16 that is formed as a steel spring here.

Figure 2:
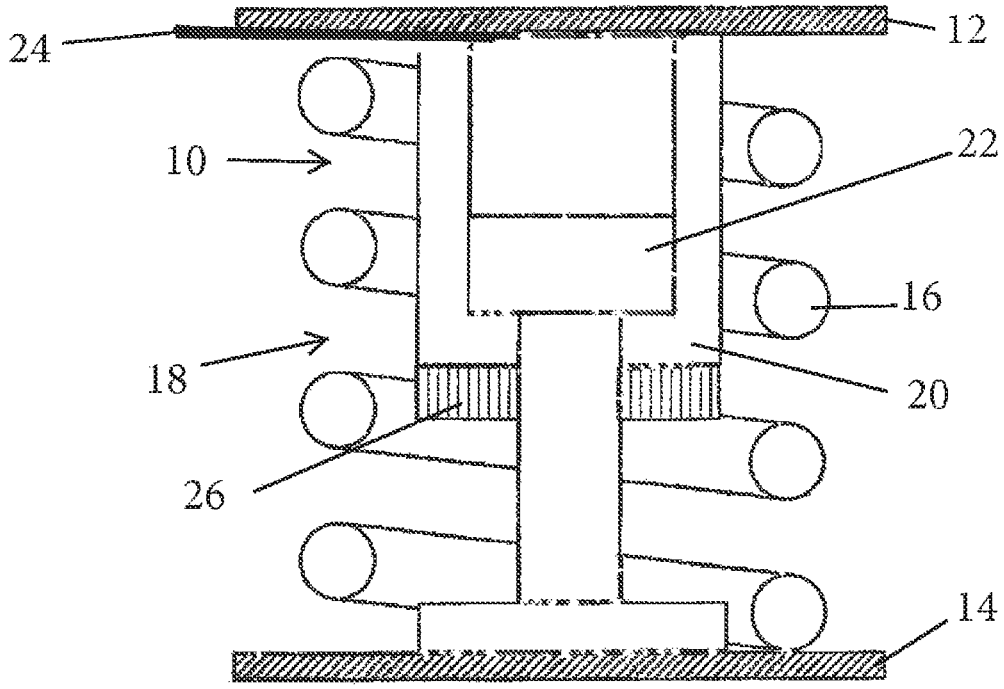
FIG. 2: the suspension unit in accordance with FIG. 1 in the fully extended state.

In FIG. 2, the reciprocating piston element 18 is now shown in an operating mode by extending the piston 22 in which operating mode the reciprocating piston element raises the body 12 with respect to the bogie 14. In the embodiment shown here, the body of the rail vehicle is raised by a maximum in that the working medium is urged into the corresponding chamber of the cylinder 20 via the pressure line 24 and the piston 22 has thus been extended up to the maximum abutment. In this state, the rail vehicle is raised to a desired maximum height, for example of a railroad station platform.

It becomes clear from the design shown in FIGS. 1 and 2 that the reciprocating piston element only supports the spring force of the spring 16 to raise the body 12 of the rail vehicle. With a corresponding dimensioning of the spring 16, only the height difference on the deflection of the spring during the loading of the rail vehicle with persons or pieces of baggage or other goods has to be adapted here.

Figure 3:
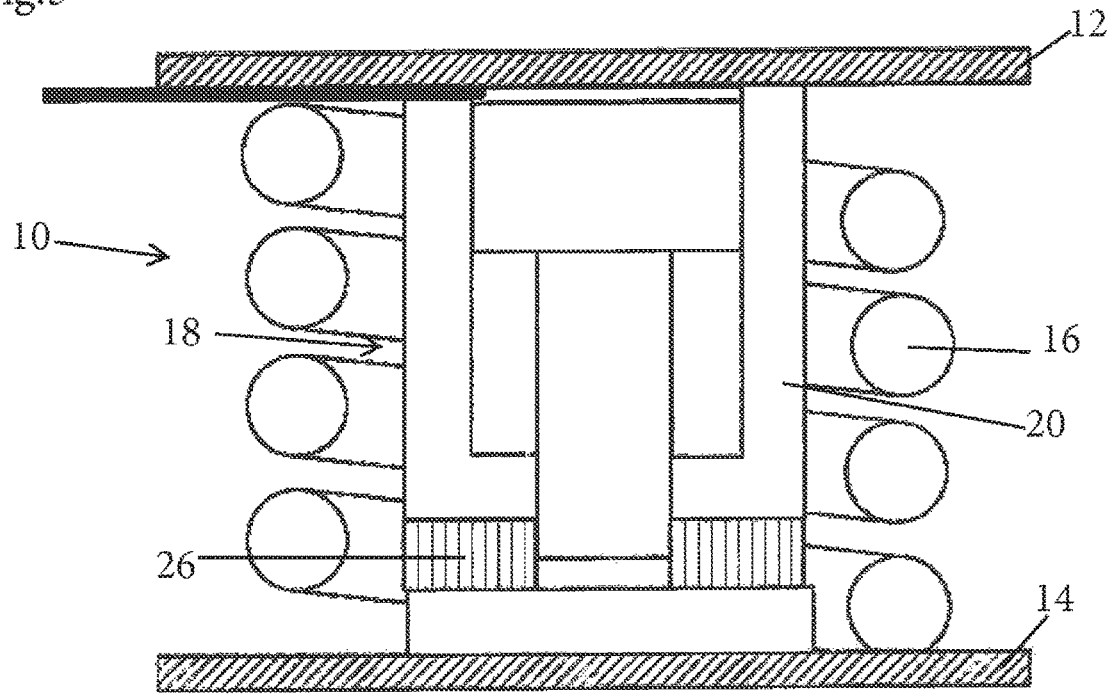
FIG. 3: the suspension unit in accordance with FIG. 1 on an overload or breakage of the spring.

The suspension unit is shown in FIG. 3 in a state in which the spring 16 no longer works appropriately. This can take place, for example, by an overload, i.e. too large a load, of the rail vehicle. The elastomer hereby comes into use as an emergency damping in that it forms an intermediate damping layer between the cylinder 20 and the bogie 14. This situation can also occur when the spring 16 has broken and can thus no longer carry out the spring function.

Figure 4:
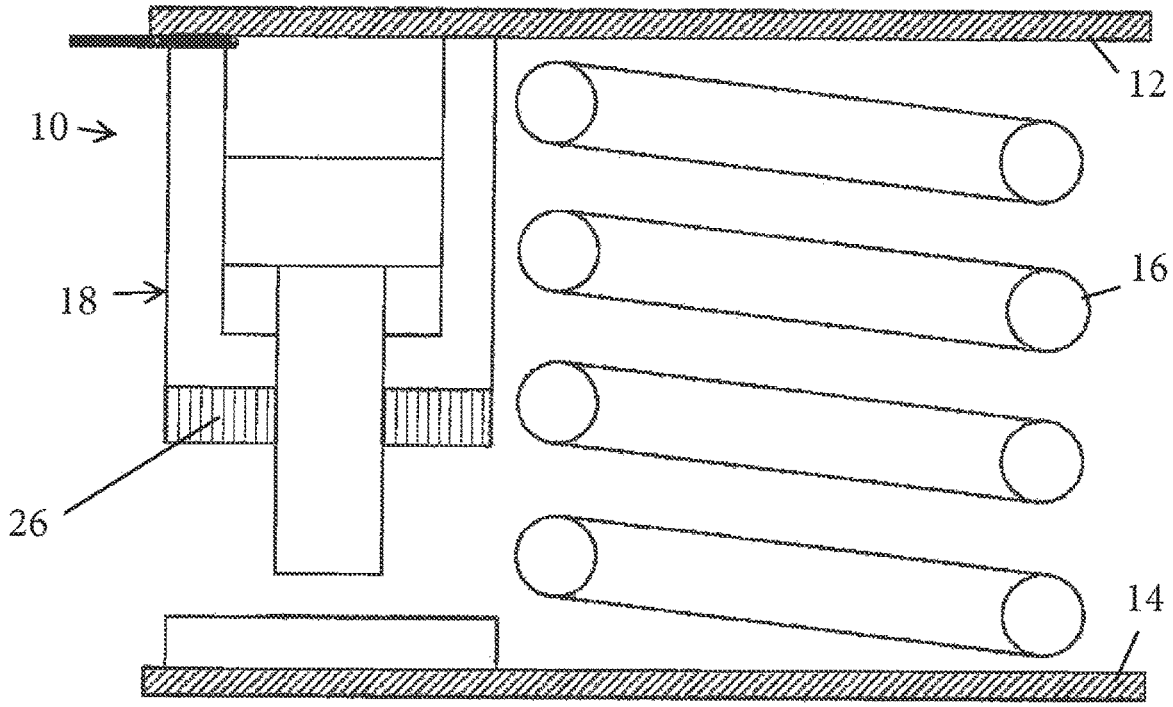
FIG. 4: an alternative embodiment of the suspension unit in accordance with the present invention in regular train operation.

FIG. 4 shows an alternative embodiment of the suspension unit 10. The reciprocating piston element 18 is here arranged outside the spring 16 and in parallel with it between the body 12 and the bogie 14. This embodiment variant otherwise corresponds to that in accordance with FIG. 1.

Figure 5:
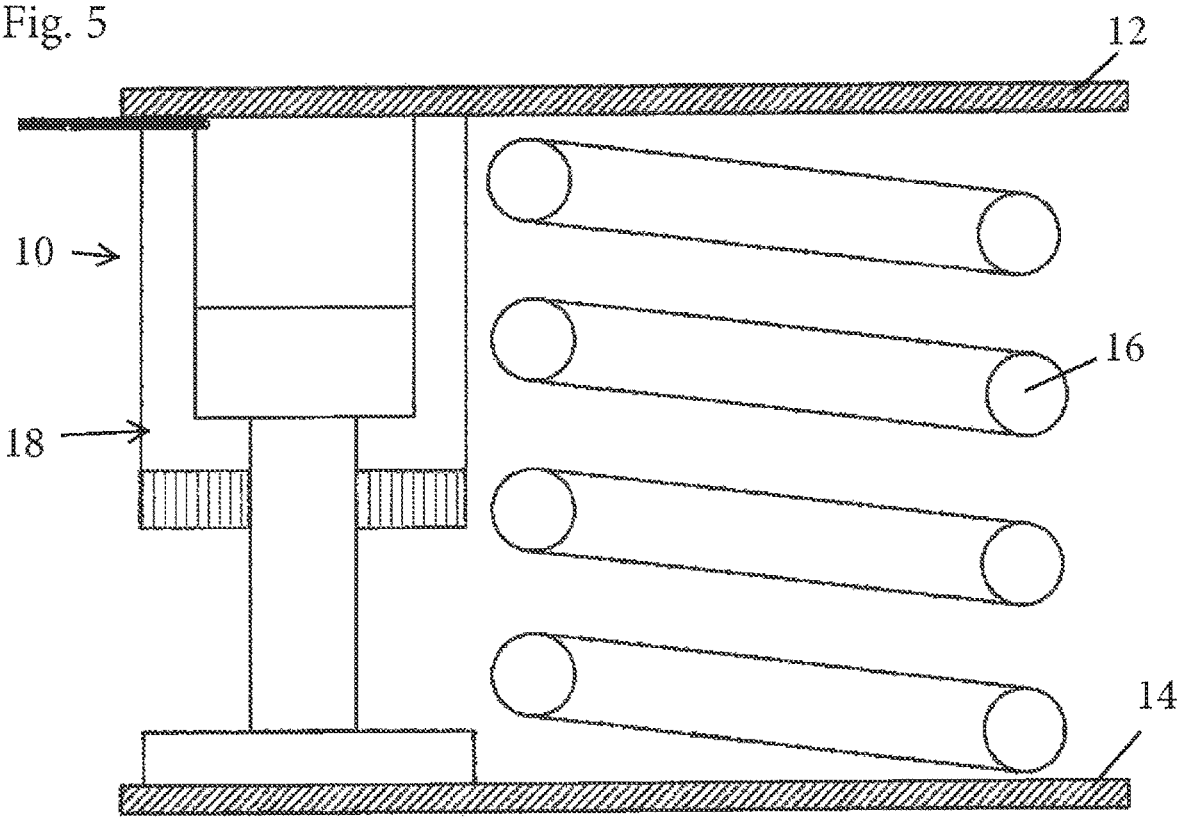
FIG. 5: the embodiment in accordance with FIG. 4 with a fully extended reciprocating piston element.

FIG. 5 shows the embodiment in accordance with FIG. 4 in the state of the reciprocating piston element 18 extended to the maximum in which the piston 22 is extended up to its end position.

Figure 6:
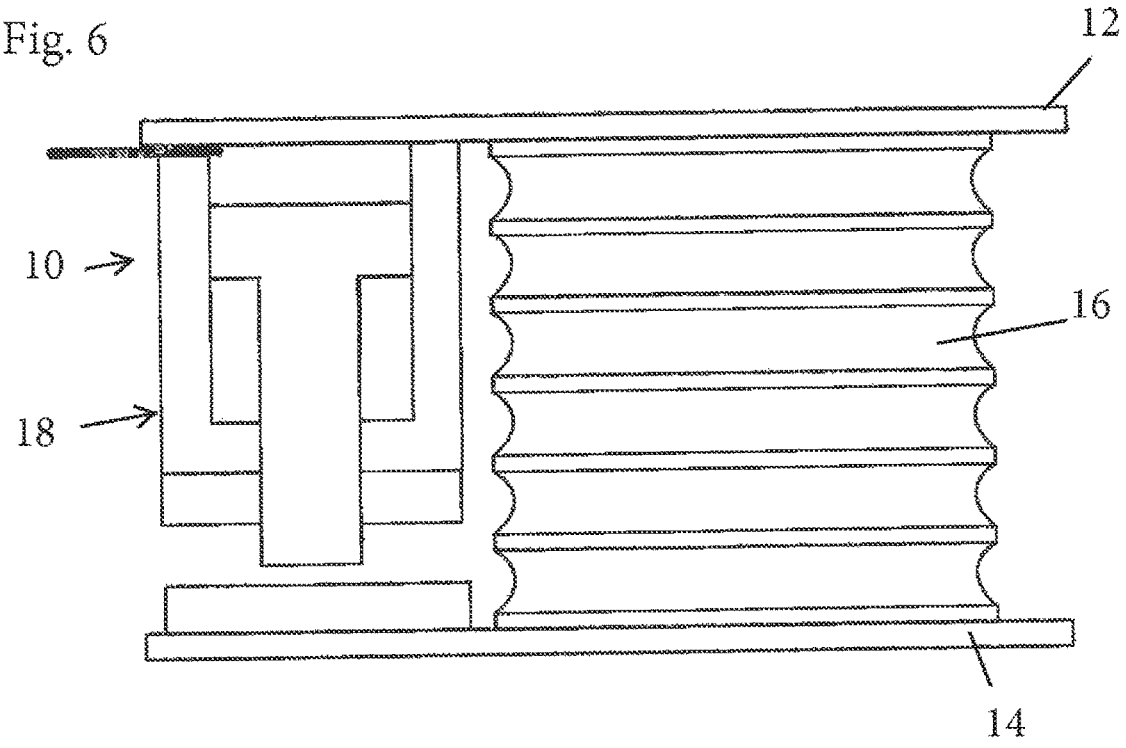
FIGS. 6 and 7: a further alternative embodiment of the suspension unit in accordance with the present invention in two different travel states.
Figure 7:
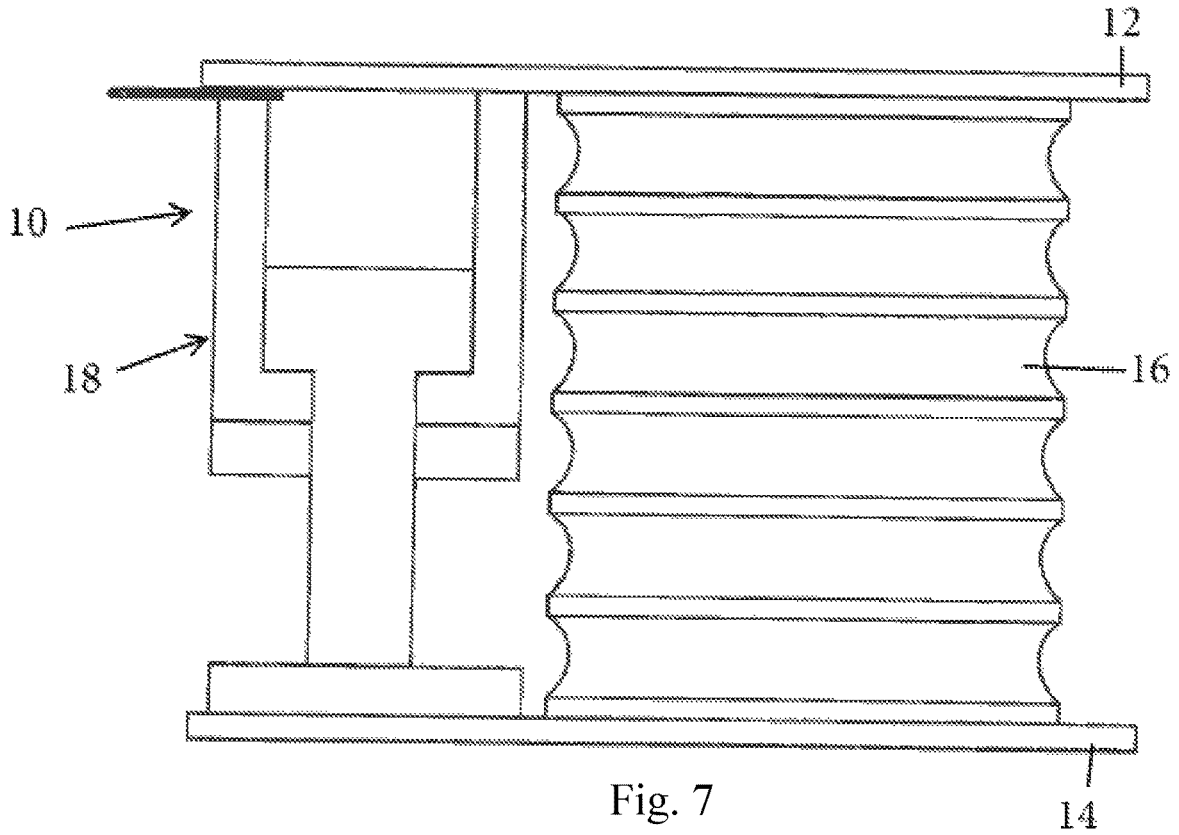

A further embodiment of the invention is shown in FIGS. 6 and 7 that substantially corresponds to the arrangement in accordance with FIGS. 5 and 6. Only the spring element 16 is not designed in the form of a steel spring, but rather as an elastomer layer spring. In FIG. 6, the suspension unit is shown in a highly deflected state that is due to the fact that the rail vehicle is relatively highly loaded. In FIG. 7, the reciprocating piston element 18 is activated and fully extended.

Figure 8:
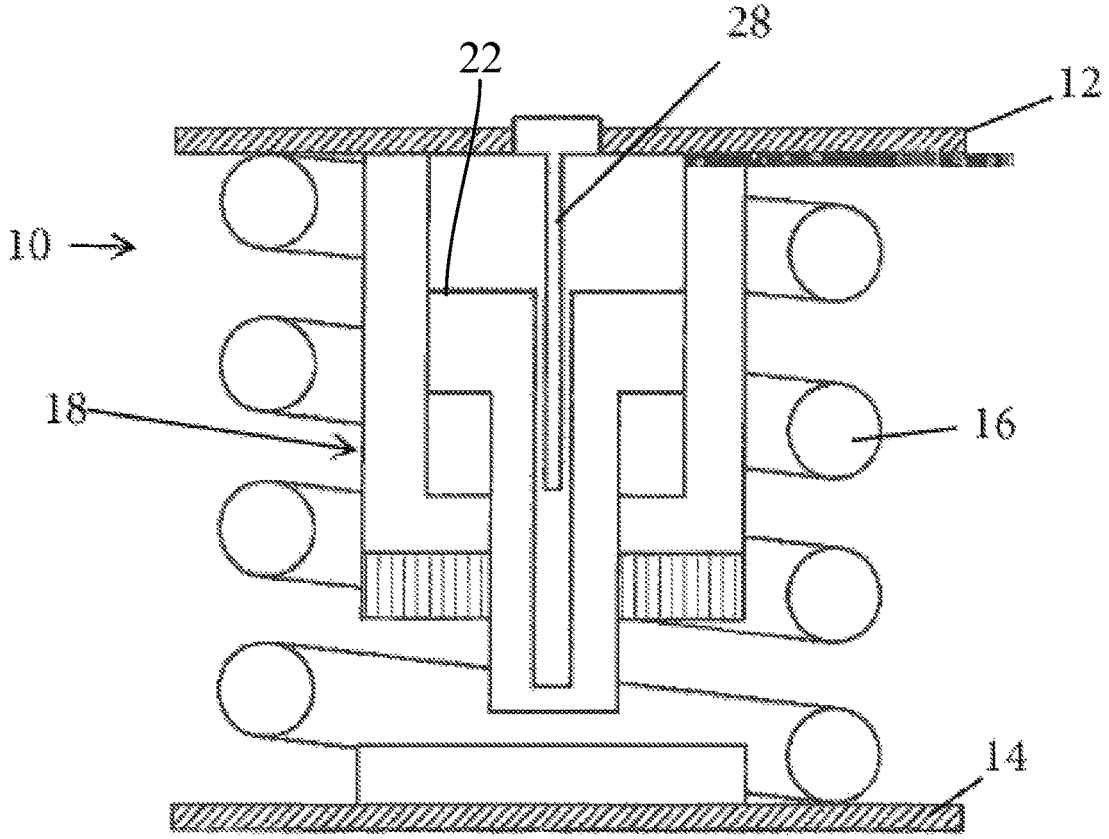
FIGS. 8 and 9: a further embodiment of the suspension unit in accordance with the invention in again different travel states.
Figure 9:
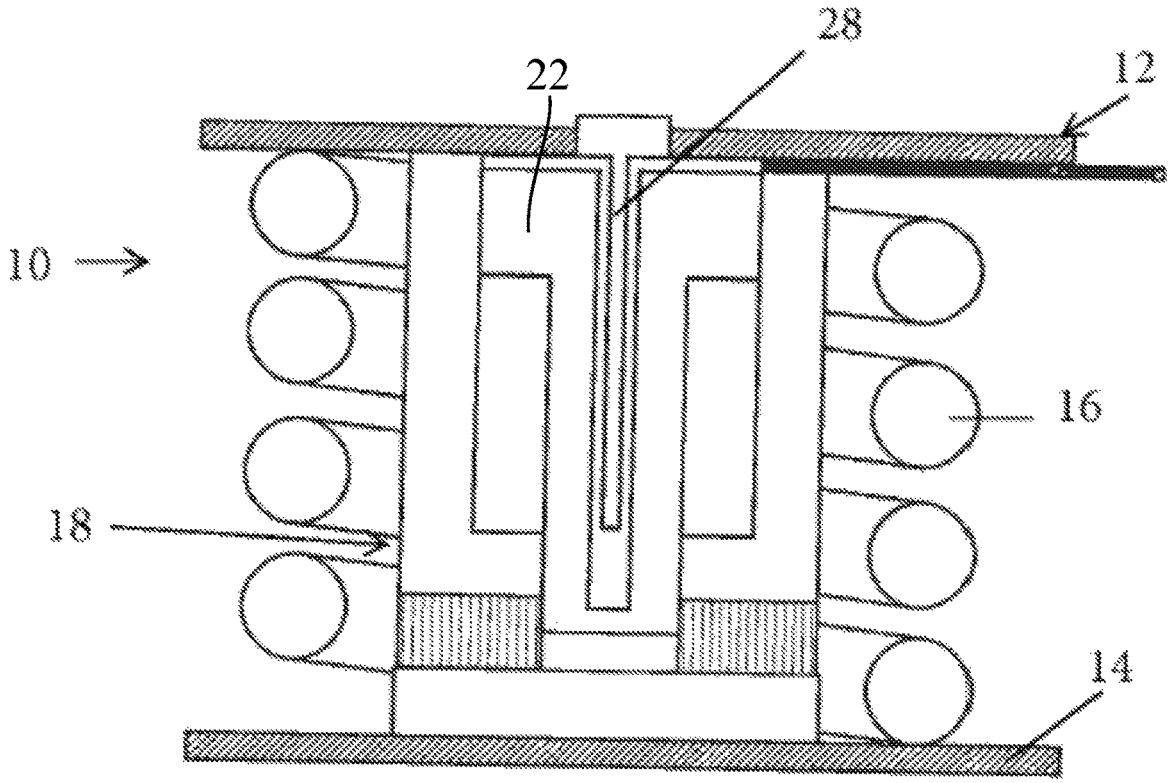

A further embodiment is shown in FIG. 8. An embodiment corresponding to that in accordance with FIG. 1 is shown here in which a distance sensor 28 is additionally integrated in the reciprocating piston element 18. As shown here, the piston 22 is designed as centrally hollow for this purpose so that the rod-shaped distance sensor 28 can dip into the piston 22. The distance sensor can thus be designed as an inductive encoder here. However, any other distance measurement system can also be used within the framework of the invention. In FIG. 9, the embodiment in accordance with FIG. 8 is shown on an overload or breakage of the spring element 16 and with a simultaneous deployment of the emergency damping by the elastomer 26. This state is indicated by the distance sensor 28 here.

Figure 10:
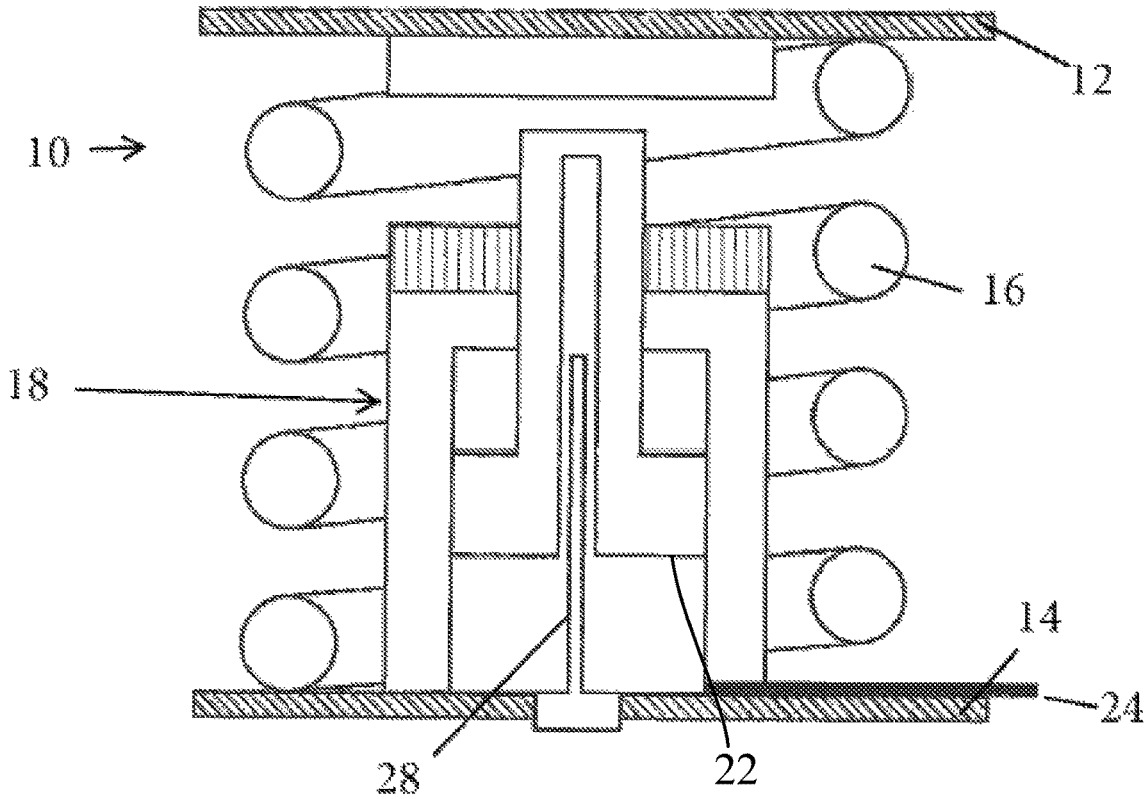
FIGS. 10 and 11: respective further modifications of the suspension units of the height control mechanism in accordance with the invention.

FIG. 10 shows an embodiment variant in which the suspension unit is installed at the bogie and in which the pressure line 24 is also led to the cylinder of the reciprocating piston element at the bogie 14. This embodiment also has a distance sensor 28.

Figure 11:
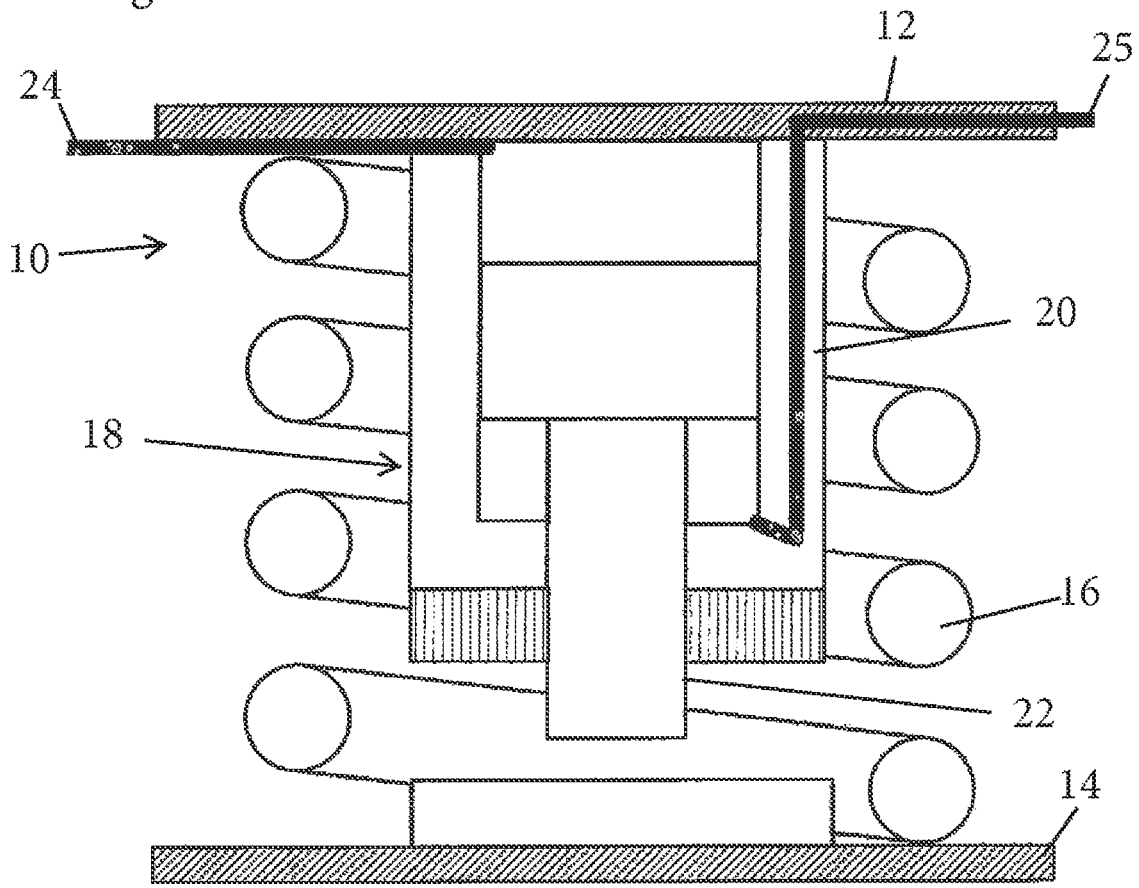

Finally, FIG. 11 shows an embodiment variant corresponding to that of FIG. 1 in which, however, the working medium is introduced into both chambers of the cylinder 20 via respective pressure lines 24 and 25 in order thus to ensure a controlled retraction of the piston 22. Otherwise, this embodiment corresponds to that in accordance with FIGS. 1 to 3.

The invention claimed is:

1. A height control mechanism for a rail vehicle comprising suspension units that are arranged between a body and a bogie of the rail vehicle and each comprise at least one spring and at least one pneumatic or hydraulic reciprocating piston element, wherein the reciprocating piston element extends to raise the body to a platform height which is greater than an operation height maintained by the at least one spring, and the reciprocating piston element retracts in train operation such that it does not bridge a spacing between the body and the bogie.

2. The height control mechanism of claim 1, wherein the reciprocating piston element is positioned within the at least one spring.

3. The height control mechanism claim 1, wherein the reciprocating piston element is arranged outside the at least one spring in parallel therewith.

4. The height control mechanism of claim 1, wherein the at least one spring is at least one of a steel spring, an air bellows, an elastomer element or a hydropneumatic spring.

5. The height control mechanism of claim 1, wherein a supply of a working medium takes place at a side of the body.

6. The height control mechanism of claim 5, wherein the supply of the working medium takes place at a side of the bogie.

7. The height control mechanism of claim 6, wherein the working medium for the reciprocating piston element is liquid or gaseous.

8. The height control mechanism of claim 1, wherein an elastomer is arranged as an emergency damping element between the bogie and the reciprocating piston element.

9. The height control mechanism in accordance with claim 8, wherein a distance measurement system cooperates directly or indirectly with the reciprocating piston element.

10. A method for adjusting a height control mechanism for a rail vehicle:

the height control mechanism comprising:

suspension units arranged between a body and a bogie of the rail vehicle and each suspension unit comprising at least one spring and at least one pneumatic or hydraulic reciprocating piston element, extending the reciprocating piston element to raise the body to a platform height, the platform height greater than an operation height, and after the rail vehicle leaves a platform, retracting the reciprocating piston element such that the reciprocating piston element does not bridge a spacing between the body and the bogie to lower the body to the operation height, and the operation height maintained by the at least one spring element.

11. The method of claim 10, wherein the platform height is based on a height of an railroad station platform.

12. The method of claim 10, wherein the platform height is independent of a weight load of the rail vehicle.

13. The method of claim 10, wherein the operation height is determined only by the at least one spring element.

14. The method of claim 10, further comprising using the reciprocating piston element to support the body in response to failure of the at least one spring element.

* * * * *